US012092402B2

(12) United States Patent
Nakata et al.

(10) Patent No.: US 12,092,402 B2
(45) Date of Patent: Sep. 17, 2024

(54) HEAT EXCHANGER

(71) Applicant: FUJITSU GENERAL LIMITED, Kanagawa (JP)

(72) Inventors: Shohei Nakata, Kanagawa (JP); Masatoshi Watanabe, Kanagawa (JP); Yoshinari Maema, Kanagawa (JP); Ryo Takaoka, Kanagawa (JP); Daiki Shimano, Kanagawa (JP); Kotaro Oka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 460 days.

(21) Appl. No.: 17/438,289

(22) PCT Filed: Jan. 29, 2020

(86) PCT No.: PCT/JP2020/003264
§ 371 (c)(1),
(2) Date: Mar. 10, 2022

(87) PCT Pub. No.: WO2020/189040
PCT Pub. Date: Sep. 24, 2020

(65) Prior Publication Data

US 2022/0243990 A1 Aug. 4, 2022

(30) Foreign Application Priority Data

Mar. 20, 2019 (JP) ..... 2019-053388

(51) Int. Cl.
*F28D 9/00* (2006.01)
*F25B 41/42* (2021.01)

(52) U.S. Cl.
CPC ..... *F28D 9/0093* (2013.01); *F25B 41/42* (2021.01); *F28F 2250/102* (2013.01)

(58) Field of Classification Search
CPC .... F28D 9/0093; F28D 1/05391; F28D 1/053; F28D 1/0417; F28D 1/0435; F24F 1/14;
(Continued)

(56) References Cited

U.S. PATENT DOCUMENTS 4,190,102 A 2/1980 Gerz
2009/0095015 A1 4/2009 Kerler et al.
(Continued)

FOREIGN PATENT DOCUMENTS

CN 101086352 A 12/2007
CN 201476415 U 5/2010
(Continued)

OTHER PUBLICATIONS

Pdf is original document of foreign reference JPS 5428160 U (Year: 1979).*
(Continued)

*Primary Examiner* — Henry T Crenshaw
*Assistant Examiner* — Kamran Tavakoldavani
(74) *Attorney, Agent, or Firm* — Paratus Law Group, PLLC

(57) ABSTRACT

A heat exchanger includes a first-row heat exchange module through which a refrigerant is introduced from the outside, a second-row heat exchange module through which the refrigerant is discharged to the outside, a third-row heat exchange module through which the refrigerant is discharged to the outside, and a flow-splitting module that splits the refrigerant from the first-row heat exchange module into the second-row heat exchange module and the third-row heat exchange module, wherein the refrigerant reciprocates one time in a flow path, the first-row heat exchange module constitutes a forward path of the flow path, and both the
(Continued)

second-row heat exchange module and the third-row heat exchange module constitute backward paths of the flow path.

2 Claims, 6 Drawing Sheets

(58) Field of Classification Search
CPC ..... F24F 1/16; F28F 9/0202; F28F 9/0265; F28F 9/028; F28F 2250/102; F25B 13/00; F25B 39/00
See application file for complete search history.

(56) References Cited

U.S. PATENT DOCUMENTS

| | | | | |
|---|---|---|---|---|
| 2009/0247038 | A1* | 10/2009 | Hama | D21H 27/22 156/229 |
| 2014/0069136 | A1* | 3/2014 | Lim | B60H 1/00778 62/436 |
| 2018/0216892 | A1* | 8/2018 | Kaneko | F28D 1/05341 |
| 2020/0049409 | A1 | 2/2020 | Matsumoto et al. | |

FOREIGN PATENT DOCUMENTS

| | | | | |
|---|---|---|---|---|
| CN | 203231589 | U | | 10/2013 |
| CN | 104457037 | A | | 3/2015 |
| EP | 3014011 | A1 | | 5/2016 |
| FR | 3034510 | A1 | | 10/2016 |
| JP | S54-028160 | U | | 2/1979 |
| JP | S 5428160 | U | * | 2/1979 |
| JP | S54-094154 | A | | 7/1979 |
| JP | S56-112471 | U | | 8/1981 |
| JP | S56-112471 | A | | 9/1981 |
| JP | 2004-163036 | A | | 6/2004 |
| JP | 2016-125671 | A | | 7/2016 |
| WO | WO 2014/206441 | A1 | | 12/2014 |
| WO | WO 2018/180934 | A1 | | 10/2018 |

OTHER PUBLICATIONS

Jul. 5, 2022, Chinese Office Action issued for related CN Application No. 202080020270.2.
Oct. 26, 2023, European Search Report issued for related EP Application No. 23179834.9.

* cited by examiner

HEAT EXCHANGER

CROSS REFERENCE TO PRIOR APPLICATION

This application is a National Stage Patent Application of PCT International Patent Application No. PCT/JP2020/003264 (filed on Jan. 29, 2020) under 35 U.S.C. § 371, which claims priority to Japanese Patent Application No. 2019-053388 (filed on Mar. 20, 2019), which are all hereby incorporated by reference in their entirety.

FIELD

The present invention relates to a heat exchanger.

BACKGROUND

Conventionally, there has been known an outdoor unit of an air conditioner in which heat exchange modules having flat tubes are connected to one another in three rows (for example, see Patent Literature 1).

As illustrated in FIG. 8, in Patent Literature 1, for the purpose of achieving uniformity of blow-out air in temperature, a first-row heat exchange module constitutes a first forward path of a refrigerant, a second-row heat exchange module constitutes a first backward path and a second forward path corresponding to the refrigerant that has been split, and a third-row heat exchange module constitutes a second backward path of the refrigerant that has joined. Note that an inlet pipe of the refrigerant connected to the first-row heat exchange module and an outlet pipe of the refrigerant connected to the third-row heat exchange module are drawn out from a header on the same side in order to shorten a length of a pipe connected to the inlet pipe or the outlet pipe in consideration of space saving.

However, the control according to the conventional art has a problem in that the refrigerant reciprocates two times along the flow paths with respect to the heat exchange modules arranged in three rows, resulting in an increase in flow path length and an increase in pressure loss. Furthermore, the second-row heat exchange module includes a first backward path and a second forward path. A difference in state and temperature of the refrigerant flowing between the first backward path and the second forward path causes a deviation in amount of heat exchange with air, resulting in a problem that the heat exchange performance of the heat exchanger deteriorates.

CITATION LIST

Patent Literature

Patent Literature 1: JP 2016-125671 A

SUMMARY

Technical Problem

The present invention solves the above-described problems, and an object of the present invention is to provide a heat exchanger capable of suppressing a pressure loss even though heat exchange modules are arranged in three rows and discharging a refrigerant in a uniform state at an outlet of each row.

Solution to Problem

According to an aspect of an embodiment, a heat exchanger includes a first-row heat exchange module through which a refrigerant is introduced from the outside, a second-row heat exchange module through which the refrigerant is discharged to the outside, a third-row heat exchange module through which the refrigerant is discharged to the outside, the first-row heat exchange module, the second-row heat exchange module, and the third-row heat exchange module are stacked in a ventilation direction, and a flow-splitting module that splits the refrigerant introduced from the first-row heat exchange module into the second-row heat exchange module and the third-row heat exchange module, wherein the refrigerant reciprocates one time in a flow path between an inlet, through which the refrigerant is introduced, and an outlet, through which the refrigerant is discharged, the first-row heat exchange module constitutes a forward path of the flow path, and both the second-row heat exchange module and the third-row heat exchange module constitute a backward path of the flow path.

Advantageous Effects of Invention

According to the present invention, it is possible to provide a heat exchanger capable of suppressing a pressure loss even though heat exchange modules are arranged in three rows and discharging a refrigerant in a uniform state at an outlet of each row.

DESCRIPTION OF EMBODIMENTS

Embodiment

Hereinafter, an embodiment of the present invention will be described in detail with reference to the accompanying drawings. Note that the present invention is not limited to the following embodiment, and various modifications can be made without departing from the gist of the present invention.

<Configuration of Refrigerant Circuit>

Figure 1A:
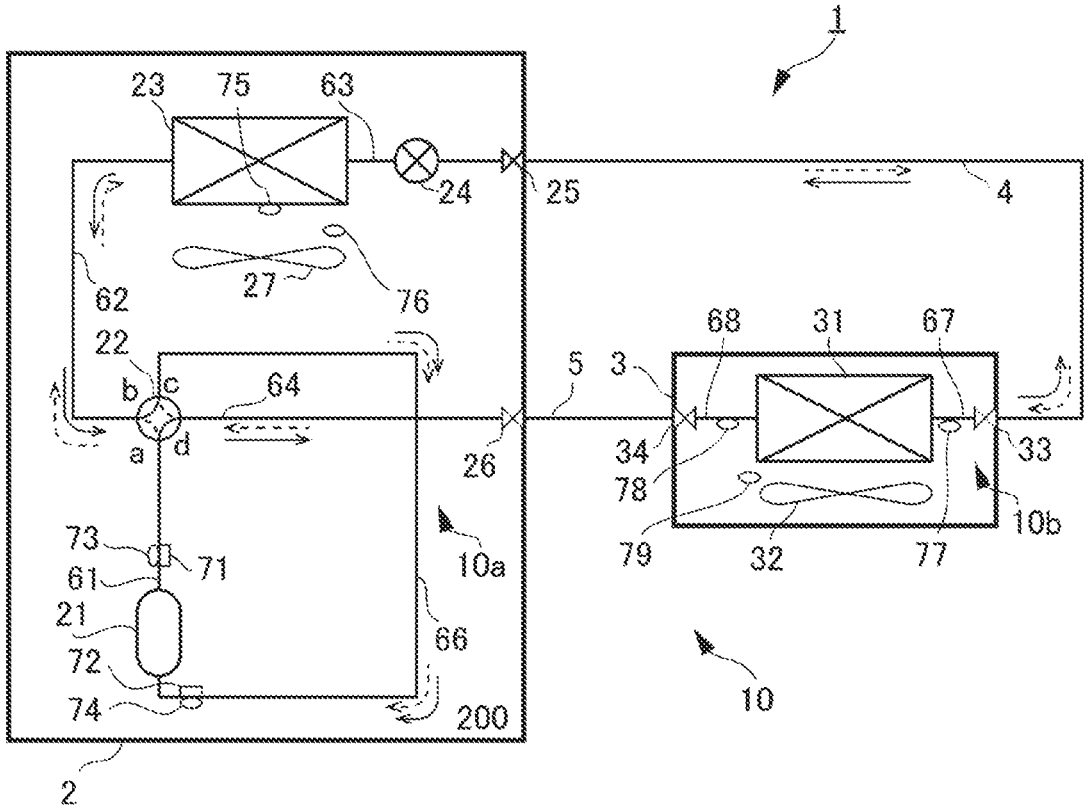
FIG. 1A, which is a diagram for explaining an air conditioner according to an embodiment of the present invention, is a refrigerant circuit diagram illustrating a refrigerant circuit of the air conditioner.

First, a refrigerant circuit of an air conditioner 1 including an outdoor unit 2 will be described with reference to FIG. 1A. As illustrated in FIG. 1A, the air conditioner 1 in the present embodiment includes an outdoor unit 2 installed outdoors, and an indoor unit 3 installed indoors and connected to the outdoor unit 2 by a liquid pipe 4 and a gas pipe 5. Specifically, a liquid-side shutoff valve 25 of the outdoor unit 2 and a liquid pipe connection portion 33 of the indoor unit 3 are connected to each other by the liquid pipe 4. In addition, a gas-side shutoff valve 26 of the outdoor unit 2 and a gas pipe connection portion 34 of the indoor unit 3 are connected to each other by the gas pipe 5. As described above, a refrigerant circuit 10 of the air conditioner 1 is formed.

<<Refrigerant Circuit of Outdoor Unit>>

First, the outdoor unit 2 will be described. The outdoor unit 2 includes a compressor 21, a four-way valve 22, an outdoor heat exchanger 23, an expansion valve 24, a liquid-side shutoff valve 25 to which the liquid pipe 4 is connected, a gas-side shutoff valve 26 to which the gas pipe 5 is connected, and an outdoor fan 27. These devices, excluding the outdoor fan 27, are connected to each other by refrigerant pipes, which will be described later, to form an outdoor unit refrigerant circuit 10*a* constituting a part of the refrigerant circuit 10. Note that an accumulator (not illustrated) may be provided on a refrigerant suction side of the compressor 21.

The compressor 21 is a capacity-variable compressor whose rotational speed can be controlled by an inverter, which is not illustrated, to change an operating capacity. A refrigerant discharge side of the compressor 21 is connected to a port a of the four-way valve 22 by a discharge pipe 61. In addition, the refrigerant suction side of the compressor 21 is connected to a port c of the four-way valve 22 by a suction pipe 66.

The four-way valve 22 is a valve for switching a refrigerant flow direction, and includes four ports a, b, c, and d. As described above, the port a is connected to the refrigerant discharge side of the compressor 21 by the discharge pipe 61. The port b is connected to one refrigerant inlet/outlet port of the outdoor heat exchanger 23 by a refrigerant pipe 62. As described above, the port c is connected to the refrigerant suction side of the compressor 21 by the suction pipe 66. The port d is connected to the gas-side shutoff valve 26 by a refrigerant pipe 64.

The outdoor heat exchanger 23 exchanges heat of outside air introduced into the outdoor unit 2 as the outdoor fan 27 rotates, which will be described later, with that of the refrigerant. One refrigerant inlet/outlet port of the outdoor heat exchanger 23 is connected to the port b of the four-way valve 22 by the refrigerant pipe 62 as described above, and the other refrigerant inlet/outlet port of the outdoor heat exchanger 23 is connected to the liquid-side shutoff valve 25 by a refrigerant pipe 63. The outdoor heat exchanger 23 functions as a condenser during a cooling operation and functions as an evaporator during a heating operation by switching the four-way valve 22, which will be described later.

The expansion valve 24 is an electronic expansion valve driven by a pulse motor, which is not illustrated. Specifically, an opened degree is adjusted according to the number of pulses applied to the pulse motor. The opened degree of the expansion valve 24 is adjusted such that a discharge temperature, which is a temperature of the refrigerant discharged from the compressor 21, reaches a predetermined target temperature during the heating operation.

The outdoor fan 27 is formed of a resin material, and is disposed near the outdoor heat exchanger 23. A central portion of the outdoor fan 27 is connected to a rotation shaft of a fan motor, which is not illustrated. The fan motor rotates to rotate the outdoor fan 27. By the rotation of the outdoor fan 27, outside air is introduced into the outdoor unit 2 through a suction port, which is not illustrated, of the outdoor unit 2, and the outside air having exchanged heat with the refrigerant in the outdoor heat exchanger 23 is released to the outside of the outdoor unit 2 through a blow-out port, which is not illustrated, of the outdoor unit 2.

In addition to the configuration described above, various sensors are provided in the outdoor unit 2. As illustrated in FIG. 1A, a discharge pressure sensor 71 detecting a pressure of the refrigerant discharged from the compressor 21, and a discharge temperature sensor 73 detecting a temperature of the refrigerant discharged from the compressor 21 (the discharge temperature described above) are provided in the discharge pipe 61. A suction pressure sensor 72 detecting a pressure of the refrigerant sucked into the compressor 21 and a suction temperature sensor 74 detecting a temperature of the refrigerant sucked into the compressor 21 are provided in the suction pipe 66.

A heat exchange temperature sensor 75 detecting an outdoor heat exchange temperature, which is a temperature of the outdoor heat exchanger 23, is provided at a substantially middle portion of a refrigerant path, which is not illustrated, of the outdoor heat exchanger 23. In addition, an outside air temperature sensor 76 detecting a temperature of outside air introduced into the outdoor unit 2, that is, an outside air temperature, is provided near the suction port, which is not illustrated, of the outdoor unit 2.

Figure 1B:
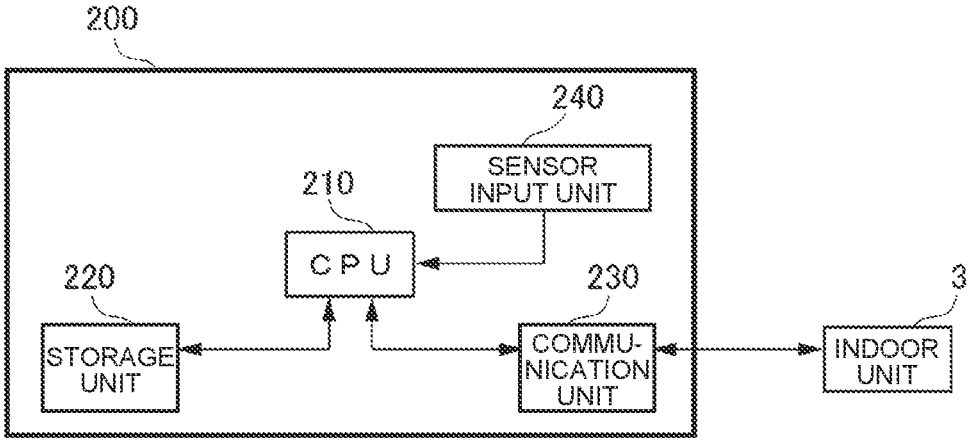
FIG. 1B is a block diagram illustrating an outdoor unit control means.

Furthermore, the outdoor unit 2 includes an outdoor unit control means 200. The outdoor unit control means 200 is mounted on a control board housed in an electric component box, which is not illustrated, of the outdoor unit 2. As illustrated in FIG. 1B, the outdoor unit control means 200 includes a CPU 210, a storage unit 220, a communication unit 230, and a sensor input unit 240 (note that, in the present specification, the outdoor unit control means 200 may be referred to simply as control means).

The storage unit 220 includes a flash memory, and stores a program for controlling the outdoor unit 2, detection values corresponding to detection signals from the various sensors, states in which the compressor 21, the outdoor fan 27, and the like are controlled, etc. In addition, although not illustrated, the storage unit 220 stores, in advance, a rotational speed table in which a rotational speed of the compressor 21 is defined based on a demanded capability to be received from the indoor unit 3.

The communication unit 230 is an interface for communication with the indoor unit 3. The sensor input unit 240 receives detection results from the various sensors of the outdoor unit 2 and outputs the detection results to the CPU 210.

The CPU 210 receives the respective detection results from the above-described sensors of the outdoor unit 2 via the sensor input unit 240. Further, the CPU 210 receives a control signal transmitted from the indoor unit 3 via the communication unit 230. The CPU 210 controls driving of the compressor 21, the outdoor fan 27, on the basis of the received detection results, control signal, and the like. In addition, the CPU 210 controls switching of the four-way valve 22 on the basis of the received detection results and control signal. Further, the CPU 210 adjusts an opened degree of the expansion valve 24 based on the received detection results and control signal.

<<Refrigerant Circuit of Indoor Unit>>

Next, the indoor unit 3 will be described with reference to FIG. 1A. The indoor unit 3 includes an indoor heat exchanger 31, an indoor fan 32, a liquid pipe connection portion 33 to which the other end of the liquid pipe 4 is connected, and a gas pipe connection portion 34 to which the other end of the gas pipe 5 is connected. These devices, excluding the indoor fan 32, are connected to each other by refrigerant pipes, which will be described in detail below, to form an indoor unit refrigerant circuit 10*b* constituting a part of the refrigerant circuit 10.

The indoor heat exchanger 31 exchanges heat of indoor air introduced into the indoor unit 3 from a suction port, which is not illustrated, of the indoor unit 3 as the indoor fan 32 rotates, which will be described later, with that of the refrigerant. One refrigerant inlet/outlet port of the indoor heat exchanger 31 is connected to the liquid pipe connection portion 33 by an indoor unit liquid pipe 67. The other refrigerant inlet/outlet port of the indoor heat exchanger 31 is connected to the gas pipe connection portion 34 by an indoor unit gas pipe 68. The indoor heat exchanger 31 functions as an evaporator when the indoor unit 3 performs the cooling operation, and functions as a condenser when the indoor unit 3 performs the heating operation.

The indoor fan 32 is formed of a resin material, and is disposed near the indoor heat exchanger 31. The indoor fan 32 is rotated by a fan motor, which is not illustrated, to introduce indoor air into the indoor unit 3 through the suction port, which is not illustrated, of the indoor unit 3, and release the indoor air having exchanged heat with the refrigerant in the indoor heat exchanger 31 into an indoor space through a blow-out port, which is not illustrated, of the indoor unit 3.

In addition to the configuration described above, various sensors are provided in the indoor unit 3. A liquid-side temperature sensor 77 detecting a temperature of the refrigerant flowing into the indoor heat exchanger 31 or flowing out of the indoor heat exchanger 31 is provided in the indoor unit liquid pipe 67. A gas-side temperature sensor 78 detecting a temperature of the refrigerant flowing out of the indoor heat exchanger 31 or flowing into the indoor heat exchanger 31 is provided in the indoor unit gas pipe 68. In addition, a room temperature sensor 79 detecting a temperature of the indoor air flowing into the indoor unit 3, that is, a room temperature, is provided near the suction port, which is not illustrated, of the indoor unit 3.

<Operation of Refrigerant Circuit>

Next, a flow of a refrigerant and an operation of each unit in the refrigerant circuit 10 during an air conditioning operation of the air conditioner 1 in the present embodiment will be described with reference to FIG. 1A. Hereinafter, the description will be provided, assuming that the indoor unit 3 performs a heating operation based on a flow of the refrigerant indicated by a solid line in the drawing. Note that a flow of the refrigerant indicated by a broken line represents a cooling operation.

When the indoor unit 3 performs the heating operation, the CPU 210 switches the four-way valve 22 to a state indicated by the solid line as illustrated in FIG. 1A, that is, such that the port a and the port d of the four-way valve 22 communicate with each other, and the port b and the port c of the four-way valve 22 communicate with each other. As a result, the refrigerant circulates in the refrigerant circuit 10 in a direction indicated by solid arrows for a heating cycle in which the outdoor heat exchanger 23 functions as an evaporator and the indoor heat exchanger 31 functions as a condenser.

The high-pressure refrigerant discharged from the compressor 21 flows through the discharge pipe 61 into the four-way valve 22. The refrigerant flowing into the port a of the four-way valve 22 flows into the refrigerant pipe 64 through the port d of the four-way valve 22, and then flows into the gas pipe 5 via the gas-side shutoff valve 26. The refrigerant flowing through the gas pipe 5 flows into the indoor unit 3 via the gas pipe connection portion 34.

The refrigerant introduced into the indoor unit 3 flows through the indoor unit gas pipe 68 into the indoor heat exchanger 31 to exchange heat with indoor air introduced into the indoor unit 3 as the indoor fan 32 rotates, so that the refrigerant is condensed. As described above, the indoor heat exchanger 31 functions as a condenser, and the indoor air having exchanged heat with the refrigerant in the indoor heat exchanger 31 is blown into the indoor space from the blow-out port, which is not illustrated, thereby heating the indoor space in which the indoor unit 3 is installed.

The refrigerant discharged from the indoor heat exchanger 31 flows through the indoor unit liquid pipe 67 into the liquid pipe 4 via the liquid pipe connection portion 33. The refrigerant introduced into the outdoor unit 2 via the liquid-side shutoff valve 25 after flowing through the liquid pipe 4 is decompressed at the time of passing through the expansion valve 24 while flowing through the refrigerant pipe 63. As described above, the opened degree of the expansion valve 24 during the heating operation is adjusted such that the discharge temperature of the compressor 21 reaches the predetermined target temperature.

The refrigerant introduced into the outdoor heat exchanger 23 after passing through the expansion valve 24 exchanges heat with the outside air introduced into the outdoor unit 2 as the outdoor fan 27 rotates, so that the refrigerant is evaporated. The refrigerant discharged from the outdoor heat exchanger 23 into the refrigerant pipe 62 flows through the port b and the port c of the four-way valve 22 and the suction pipe 66, and is sucked into the compressor 21 so that the refrigerant is compressed again.

<Heat Exchanger and Refrigerant Flow Paths>

In the outdoor heat exchanger 23 (hereinafter, referred to as heat exchanger 23) according to the present embodiment, heat exchange modules 50 including flat tubes (heat transfer tubes) are provided in three rows.

Hereinafter, the heat exchanger 23 and refrigerant flow paths therein will be described with reference to FIGS. 2 to 8, while being compared with a conventional heat exchanger.

Figure 8:
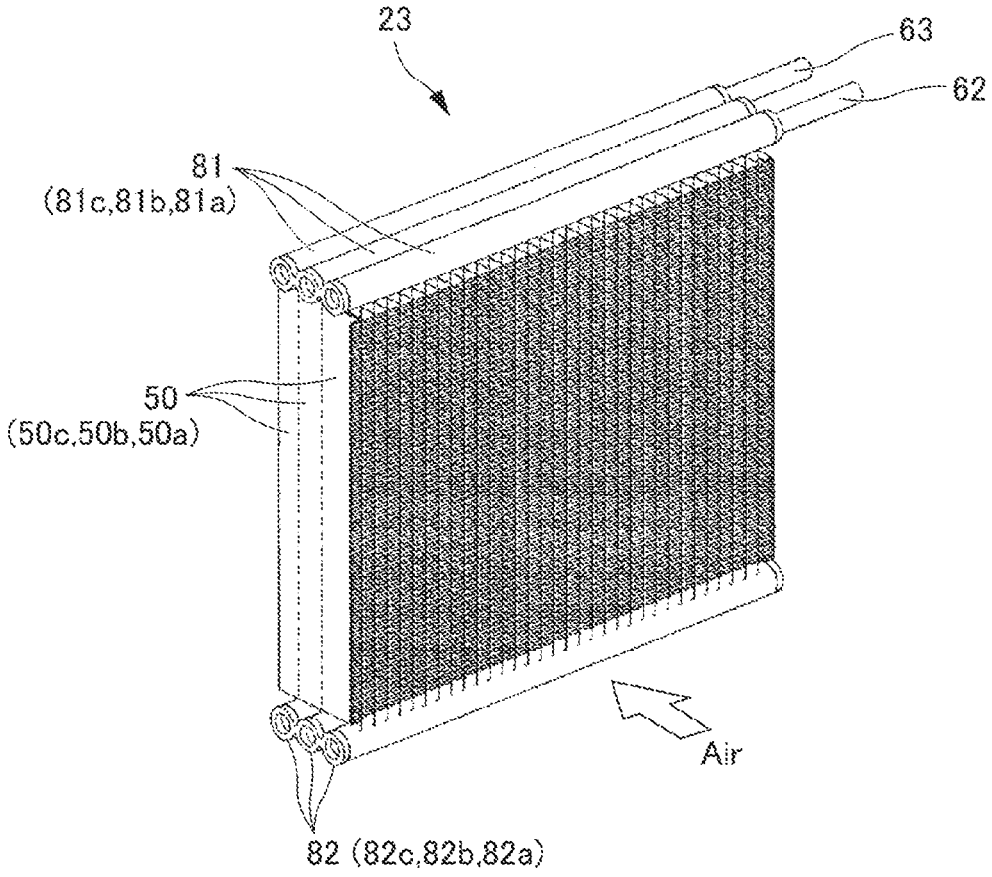
FIG. 8 is a perspective view illustrating a three-row heat exchanger according to the conventional art.

First, a conventional heat exchanger 23 will be described with reference to FIG. 8. As illustrated in FIG. 8, the heat exchanger 23 includes three rows of heat exchange modules 50 (50*a*, 50*b*, and 50*c*). An upper header 81 (81*a*, 81*b*, or 81*c*) and a lower header 82 (82*a*, 82*b*, or 82*c*) are provided at both ends of each row, respectively. A refrigerant pipe 63 (hereinafter, referred to as inlet pipe 63), through which the refrigerant is introduced from the outside, is connected to the first upper header 81*c*, and a refrigerant pipe 62 (hereinafter, referred to as outlet pipe 62), through which the refrigerant is discharged to the outside, is provided at the third upper header 81*a*. A windward side in a ventilation direction is set to a first-row heat exchange module 50*a* side. On a leeward side of the first-row heat exchange module 50*a*, the second-row heat exchange module 50*b* and the third-row heat exchange module 50*c* are arranged in order. Note that the suffixes "a", "b", and "c" are given in order as viewed from the windward side in the ventilation direction.

Figure 7:
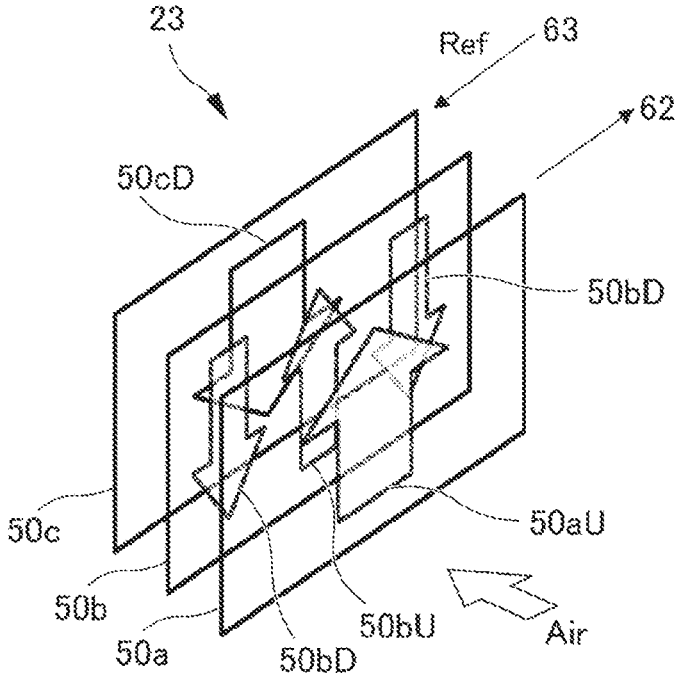
FIG. 7 is a perspective view schematically illustrating flow paths along which a refrigerant reciprocates two times in a three-row heat exchanger.

FIG. 7 schematically illustrates a refrigerant flow path in the conventional heat exchanger 23 of FIG. 8 (the headers 81 and 82 at the both ends of FIG. 8 are omitted). That is, the refrigerant introduced from the inlet pipe 63 into the third-row heat exchange module 50*c* flows from the first upper header 81*c* toward the first lower header 82*c* through a first forward path 50*c*D. The refrigerant introduced into the first lower header 82*c* flows into the second lower header 82*b* and then flows toward the second upper header 81*b* through a first backward path 50*b*U disposed in a central portion of the second-row heat exchange module 50*b*. The refrigerant split in the second upper header 81*b* flows toward the second lower header 82*b* through second forward paths 50*b*D disposed on both sides of the first backward path 50*b*U of the second-row heat exchange module 50*b*. Then, the refrigerant joining in the third lower header 82*a* flows toward the third upper header 81*a* through a second backward path 50*a*U in the first-row heat exchange modules 50*a*, and then is discharged from the third upper header 81*a* to the outside via the outlet pipe 62.

In this way, in the refrigerant flow paths of the conventional heat exchanger 23, the refrigerant reciprocates two times to flow through all of the three rows of heat exchange modules 50*c*, 50*b*, and 50*a* by splitting the refrigerant in the second-row heat exchange module 50*b*, that is, in one heat exchange module 50. Therefore, since the refrigerant reciprocates in a large number of times, it is not possible to reduce a pressure loss.

Figure 2:
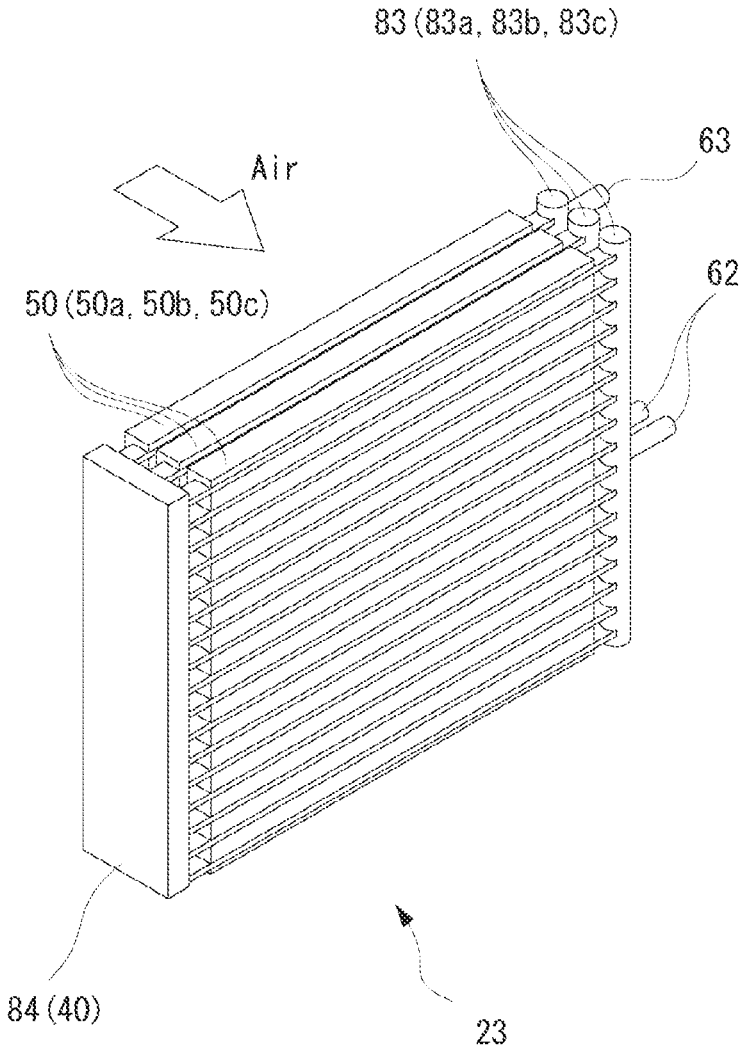
FIG. 2 is a perspective view illustrating a heat exchanger according to the embodiment of the present invention.

At this point, in the heat exchanger 23 according to the present embodiment, a flow-splitting module 40, which will be described later, makes it possible for the refrigerant to reciprocate one time to flow through all of the three rows of heat exchange modules 50*c*, 50*b*, and 50*a* between the inlet, through which the refrigerant is introduced, and the outlet, through which the refrigerant is discharged, of the heat exchanger 23, thereby reducing the pressure loss. First, a heat exchanger 23 according to the present embodiment will be described with reference to FIG. 2. The same configurations as those in the conventional heat exchanger 23 of FIG. 8 are denoted by the same reference signs. As illustrated in FIG. 2, in the heat exchanger 23, three rows of heat exchange modules 50 (50*a*, 50*b*, and 50*c*) are stacked in the ventilation direction. A back-side header 83 (83*a*, 83*b*, or 83*c*) and a front-side header 84 (a flow-splitting module 40 to be described later) are provided at both ends of each row, respectively. An inlet pipe 63, through which the refrigerant is introduced from the outside, is connected to the first back-side header 83*a*, and outlet pipes 62, through which the refrigerant is discharged to the outside, are provided at the second back-side header 83*b* and the third back-side header 83*c*, respectively. A windward side in a ventilation direction is set to a first-row heat exchange module 50*a* side. Note that the suffixes "a", "b", and "c" are given in order as viewed from the windward side in the ventilation direction.

Figure 3:
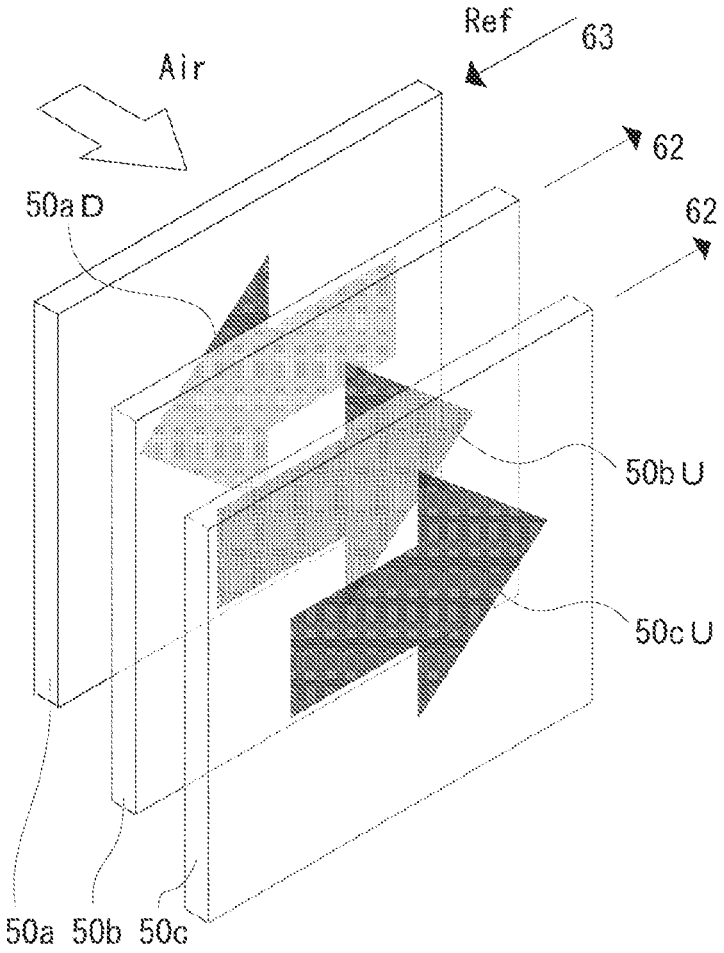
FIG. 3 is a perspective view schematically illustrating flow paths along which a refrigerant reciprocates one time in a three-row heat exchanger.

In the heat exchanger 23 of the present embodiment, as illustrated in FIG. 3 (for the omitted headers 83 and 84 provided at both ends, see FIG. 2), the refrigerant reciprocates one time along the refrigerant flow paths to flow through the three rows of heat exchange modules 50*a*, 50*b*, and 50*c*. That is, the refrigerant introduced into the first-row heat exchange modules 50*a* through the inlet pipe 63 flows through a forward path 50*a*D forwardly from the first back-side header 83*a*. The refrigerant split by the flow-splitting module 40, which will be described later, in the front-side header 84 flows toward the second back-side header 83*b* through a first backward path 50*b*U corresponding to the second-row heat exchange module 50*b*, and at the same time, flows toward the third back-side header 83*c* through a second backward path 50*c*U corresponding to the third-row heat exchange module 50*c*. Then, the former is discharged from the second back-side header 83*b* to the outside via one outlet pipe 62, and the latter is discharged from the third back-side header 83*c* to the outside via the other outlet pipe 62.

In this way, in the refrigerant flow paths of the heat exchanger 23 according to the present embodiment, the refrigerant reciprocates one time to flow through all of the three rows of heat exchange modules 50*a*, 50*b*, and 50*c* by splitting the refrigerant into the first-row heat exchange module 50*a*, the second-row heat exchange module 50*b*, and the third-row heat exchange module 50*c*. Therefore, since the number of times the refrigerant reciprocates is reduced and a flow path length is shortened, it is possible to suppress a pressure loss.

Furthermore, when the refrigerant flows in one reciprocation as compared with the conventional two reciprocations, a heat exchange amount is not reduced, while the flow path length is shortened. This is because a flow velocity of the refrigerant is smaller when the refrigerant flows through two rows of heat exchange modules 50 as backward paths in parallel than when the refrigerant is split within one row of heat exchange module 50 in the conventional art. Thus, the present invention is not different from the conventional art in terms of a time during which the refrigerant is in contact with air, that is, a time during which the refrigerant flows through the flat tubes (heat transfer tubes), thereby not affecting a heat exchange amount.

<<Flow-Splitting Module>>

Next, a means for splitting the refrigerant to be returned into the two rows of heat exchange modules 50*b* and 50*c*, which are backward paths, in the front-side header 84 will be described. When the number of rows of heat exchange modules 50 is three in order to increase a heat exchange amount, temperatures of air passing through the second-row heat exchange module 50*b* and the third-row heat exchange module 50*c* arranged in parallel, respectively, are different from each other. Specifically, the air having passed through the second-row heat exchange module 50*b* passes through the third-row heat exchange module 50*c* positioned on the leeward side in the ventilation direction. Therefore, in the third-row heat exchange module 50*c*, a temperature difference between the air and the refrigerant is relatively small, causing a difference in heat exchange amount.

When the same amount of refrigerant flows to the second-row heat exchange module 50*b* and the third-row heat exchange module 50*c* that are different in heat exchange amount, there is a deviation in state of the refrigerant between the outlets of the two heat exchange modules. Hereinafter, a case where the present heat exchanger 23 is used as a condenser will be exemplified. Since the refrigerant flowing through the second-row heat exchange module 50*b* positioned on the windward side has a large temperature difference from the air, a heat exchange amount increases, resulting in an increase in supercooled degree of the refrigerant at the outlet. On the other hand, the refrigerant flowing through the third-row heat exchange module 50*c* positioned on the leeward side exchanges heat with the air having passed through the second-row heat exchange module 50*b*. That is, since the refrigerant flowing through the third-row heat exchange module 50*c* has a small temperature difference from the air, a heat exchange amount decreases, resulting in a decrease in supercooled degree of the refrigerant at the outlet, or a gas-liquid two-phase state of the refrigerant rather than being supercooled. As a result, in the second-row heat exchange module 50*b*, a liquid single-phase region having a small contribution to heat exchange between the refrigerant and the air is widened, resulting in a deterioration in heat exchange performance of the heat exchanger 23. At this point, in order to make the state of the refrigerant uniform between the outlets of the second-row heat exchange module 50*b* and the third-row heat exchange module 50*c*, in the present embodiment, the flow-splitting module 40 is provided in the front-side header 84 to adjust a split amount of the refrigerant such that the refrigerant flows in a larger amount on the windward side than on the leeward side.

Figure 4:
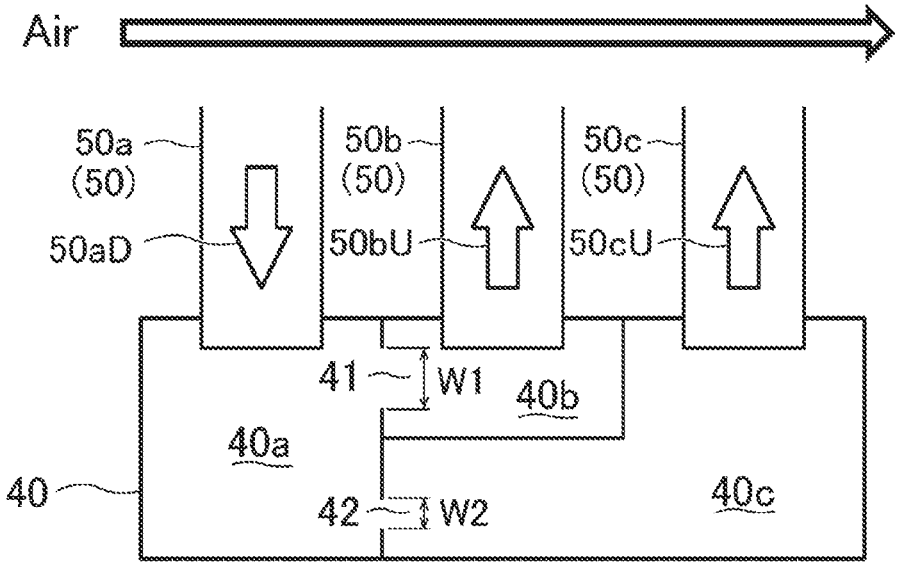
FIG. 4 is a view illustrating one aspect of a flow-splitting module.

FIG. 4 illustrates an example of the flow-splitting module 40. The flow-splitting module 40 includes a first flow-splitting chamber 40*a*, a second flow-splitting chamber 40*b*, and a third flow-splitting chamber 40*c* communicating with the first-row heat exchange module 50*a*, the second-row heat exchange module 50*b*, and the third-row heat exchange module 50*c*, respectively. In addition, a diameter W1 of a first inflow port 41 connecting the first flow-splitting chamber 40*a* and the second flow-splitting chamber 40*b* to each other is set to be larger than a diameter W2 of a second inflow port 42 connecting the first flow-splitting chamber 40*a* and the third flow-splitting chamber 40*c* to each other. As a result, the refrigerant having flowed out of the forward path 50*a*D is split such that an amount of the refrigerant flowing toward the first backward path 50*b*U is larger than that of the refrigerant flowing toward the second backward path 50*c*U.

Figure 5:
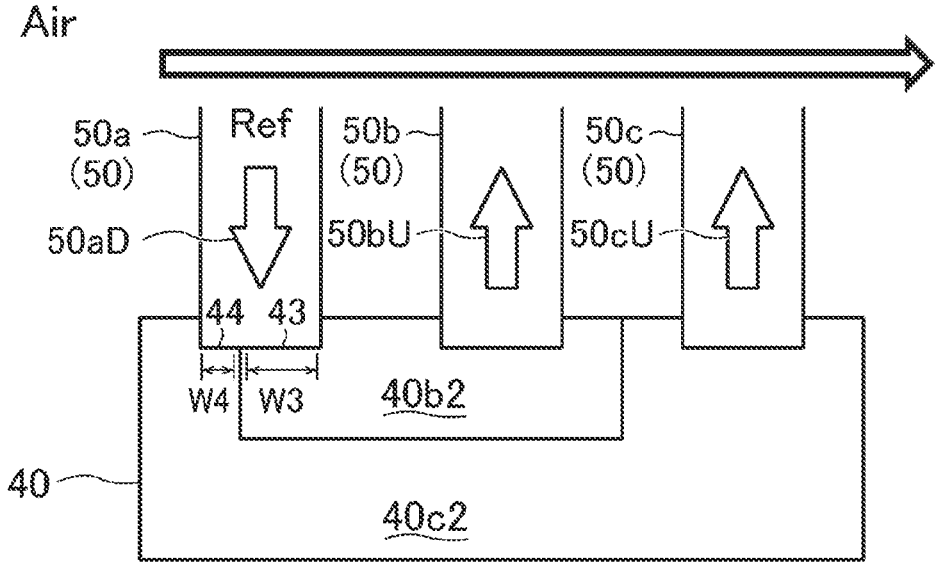
FIG. 5 is a view illustrating another aspect of the flow-splitting module.

FIG. 5 illustrates another example of the flow-splitting module 40. The flow-splitting module 40 includes a fourth flow-splitting chamber 40*b*2 allowing communication between the first-row heat exchange module 50*a* and the second-row heat exchange module 50*b*, and a fifth flow-splitting chamber 40*c*2 allowing communication between the first-row heat exchange module 50*a* and the third-row heat exchange module 50*c*. In addition, a diameter W3 of a third inflow port 43 connecting the first-row heat exchange module 50*a* and the fourth flow-splitting chamber 40*b*2 to each other is set to be larger than a diameter W4 of a fourth inflow port 44 connecting the first-row heat exchange module 50*a* and the fifth flow-splitting chamber 40*c*2. As a result, the refrigerant having flowed out of the forward path 50*a*D is split such that an amount of the refrigerant flowing toward the first backward path 50*b*U is larger than that of the refrigerant flowing toward the second backward path 50*c*U.

Figure 6:
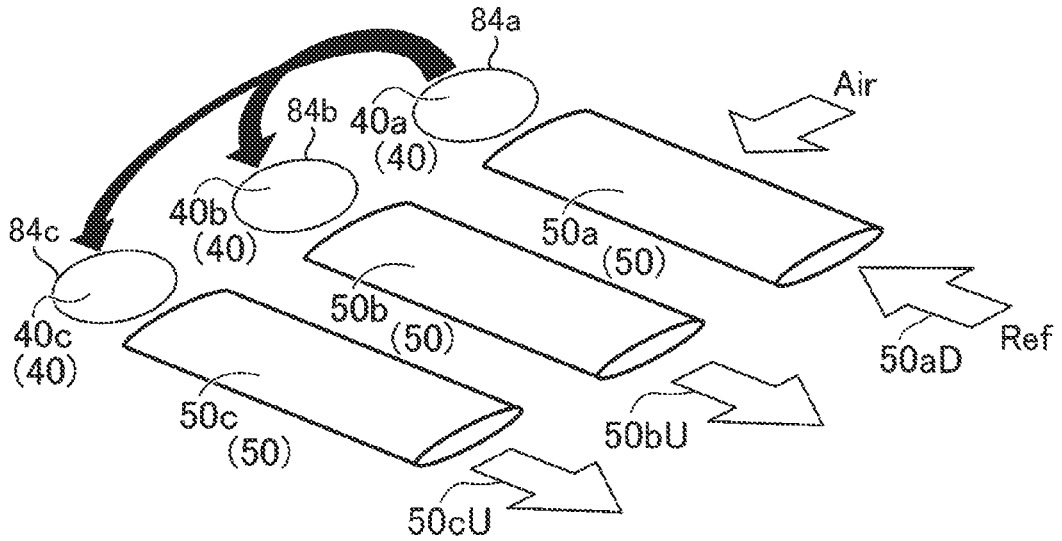
FIG. 6 is a view illustrating another aspect of the flow-splitting module.

In FIGS. 4 and 5, the flow-splitting module 40 is illustrated as one casing, but the aspect is not limited thereto. For example, as schematically illustrated in FIG. 6, the first flow-splitting chamber 40*a*, the second flow-splitting chamber 40*b*, and the third flow-splitting chamber 40*c* may be provided in a first front-side header 84*a*, a second front-side header 84*b*, and a third front-side header 84*c* corresponding to the first-row heat exchange module 50*a*, the second-row heat exchange module 50*b*, and the third-row heat exchange module 50*c*, respectively, and a diameter of a pipe connecting the first flow-splitting chamber 40*a* to the second flow-splitting chamber 40*b* may be set to be larger than that of a pipe connecting the first flow-splitting chamber 40*a* to the third flow-splitting chamber 40*c*.

REFERENCE SIGNS LIST

1 AIR CONDITIONER
2 OUTDOOR UNIT
3 INDOOR UNIT
4 LIQUID PIPE
5 GAS PIPE
10 REFRIGERANT CIRCUIT
10*a* OUTDOOR UNIT REFRIGERANT CIRCUIT
10*b* INDOOR UNIT REFRIGERANT CIRCUIT
21 COMPRESSOR
22 FOUR-WAY VALVE
23 OUTDOOR HEAT EXCHANGER
24 EXPANSION VALVE
25 LIQUID-SIDE SHUTOFF VALVE
26 GAS-SIDE SHUTOFF VALVE
27 OUTDOOR FAN
31 INDOOR HEAT EXCHANGER
32 INDOOR FAN
33 LIQUID PIPE CONNECTION PORTION
34 GAS PIPE CONNECTION PORTION
40 FLOW-SPLITTING MODULE
50 HEAT EXCHANGE MODULE
61 DISCHARGE PIPE
62 REFRIGERANT PIPE (OUTLET PIPE)
63 REFRIGERANT PIPE (INLET PIPE)
64 REFRIGERANT PIPE
66 SUCTION PIPE
67 INDOOR UNIT LIQUID PIPE
68 INDOOR UNIT GAS PIPE
71 DISCHARGE PRESSURE SENSOR
72 SUCTION PRESSURE SENSOR
73 DISCHARGE TEMPERATURE SENSOR
74 SUCTION TEMPERATURE SENSOR
75 HEAT EXCHANGE TEMPERATURE SENSOR
76 OUTSIDE AIR TEMPERATURE SENSOR
77 LIQUID-SIDE TEMPERATURE SENSOR
78 GAS-SIDE TEMPERATURE SENSOR
79 ROOM TEMPERATURE SENSOR
81 UPPER HEADER
82 LOWER HEADER
200 OUTDOOR UNIT CONTROL MEANS
210 CPU
220 STORAGE UNIT
230 COMMUNICATION UNIT
240 SENSOR INPUT UNIT

The invention claimed is:

1. A heat exchanger comprising:

a first-row heat exchange module through which a refrigerant is introduced from outside;

a second-row heat exchange module through which the refrigerant is discharged to the outside;

a third-row heat exchange module through which the refrigerant is discharged to the outside, the first-row heat exchange module, the second-row heat exchange module, and the third-row heat exchange module are stacked in a ventilation direction; and a flow-splitting module that splits the refrigerant introduced from the first-row heat exchange module into the second-row heat exchange module and the third-row heat exchange module, wherein the refrigerant reciprocates one time in a flow path between an inlet, through which the refrigerant is introduced, and an outlet, through which the refrigerant is discharged, the first-row heat exchange module constitutes a forward path of the flow path, and both the second-row heat exchange module and the third-row heat exchange module constitute a backward path of the flow path, the flow-splitting module includes a first flow-splitting chamber, a second flow-splitting chamber, and a third flow-splitting chamber that communicate with the first-row heat exchange module, the second-row heat exchange module, and the third-row heat exchange module, respectively, a diameter of a first inflow port connecting the first flow-splitting chamber and the second flow-splitting chamber to each other is larger than a diameter of a second inflow port connecting the first flow-splitting chamber and the third flow-splitting chamber to each other, and the flow-splitting module splits the refrigerant such that an amount of the refrigerant flowing into the second-row heat exchange module arranged on a windward side in the ventilation direction is larger than an amount of the refrigerant flowing into the third-row heat exchange module on a leeward side arranged in the ventilation direction of the second-row heat exchange module.

2. A heat exchanger comprising:

a first-row heat exchange module through which a refrigerant is introduced from the outside;

a second-row heat exchange module through which the refrigerant is discharged to the outside;

a third-row heat exchange module through which the refrigerant is discharged to the outside, the first-row heat exchange module, the second-row heat exchange module, and the third-row heat exchange module are stacked in a ventilation direction; and a flow-splitting module that splits the refrigerant introduced from the first-row heat exchange module into the second-row heat exchange module and the third-row heat exchange module, wherein the refrigerant reciprocates one time in a flow path between an inlet, through which the refrigerant is introduced, and an outlet, through which the refrigerant is discharged, the first-row heat exchange module constitutes a forward path of the flow path, and both the second-row heat exchange module and the third-row heat exchange module constitute a backward path of the flow path, the flow-splitting module includes a first flow-splitting chamber that communicates the first-row heat exchange module and the second-row heat exchange module, and a second flow-splitting chamber that communicates the first-row heat exchange module and the third-row heat exchange module, a diameter of a first inflow port connecting the first-row heat exchange module and the first flow-splitting chamber to each other is larger than a diameter of a second inflow port connecting the first-row heat exchange module and the second flow-splitting chamber to each other, and the flow-splitting module splits the refrigerant such that an amount of the refrigerant flowing into the second-row heat exchange module arranged on a windward side in the ventilation direction is larger than an amount of the refrigerant flowing into the third-row heat exchange module on a leeward side arranged in the ventilation direction of the second-row heat exchange module.

* * * * *